US007299926B2

(12) United States Patent
Russell et al.

(10) Patent No.: US 7,299,926 B2
(45) Date of Patent: Nov. 27, 2007

(54) PACKAGING INSERT AND METHOD

(75) Inventors: Paul Grady Russell, Campbell, CA (US); Matthew Daum, Eagle, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 495 days.

(21) Appl. No.: 10/914,845

(22) Filed: Aug. 10, 2004

(65) Prior Publication Data

US 2006/0032777 A1 Feb. 16, 2006

(51) Int. Cl.
*B65D 81/02* (2006.01)

(52) U.S. Cl. ..... 206/583; 206/521; 206/591

(58) Field of Classification Search ..... 206/521, 206/583, 588, 591, 592, 594
See application file for complete search history.

(56) References Cited

U.S. PATENT DOCUMENTS

| | | | | |
|---|---|---|---|---|
| 1,728,894 | A * | 9/1929 | Oppenheim | 206/521 |
| 2,979,248 | A * | 4/1961 | Washington | 206/591 |
| 3,294,223 | A | 12/1966 | Goban | |
| 4,923,065 | A | 5/1990 | Ridgeway | |
| 4,981,215 | A * | 1/1991 | Ilic | 206/521 |
| 5,040,684 | A | 8/1991 | Knowles | |
| 5,226,543 | A | 7/1993 | Foos et al. | |
| 5,467,873 | A | 11/1995 | Kastenhofer | |
| 5,515,976 | A | 5/1996 | Moren et al. | |
| 5,799,796 | A | 9/1998 | Azelton et al. | |
| 5,823,352 | A * | 10/1998 | Mena et al. | 206/721 |
| 5,975,307 | A * | 11/1999 | Harding et al. | 206/583 |
| 6,520,337 | B2 | 2/2003 | Smith | |
| 6,685,026 | B1 | 2/2004 | Hanna | |
| 2004/0178113 | A1 * | 9/2004 | Lofgren et al. | 206/583 |
| 2005/0224390 | A1 * | 10/2005 | Auclair | 206/588 |

OTHER PUBLICATIONS

Author Unknown, Product brochure entitled "Sealed Air, Korrvu Suspension and Retention Packaging," published on the Internet at http://www.sealed air.com/products/protective/korrvu/korrvu_designed.htm, pp. 1-6, Copyright 2003. (Month of publishing is not at issue).

Author Unknown, "Korrvu Suspension and Retention Packaging-Sealed Air," Website published on the Internet at http://www.sealedair.com/products/protective/korrvu/korrvu_designed.htm, pp. 1-4, Copyright 2003 (Month of publishing is not at issue).

* cited by examiner

*Primary Examiner*—David T. Fidei

(57) ABSTRACT

Various embodiments of a packaging insert and method for assembling a packaging insert are provided. In one embodiment a packaging insert for supporting an article in a shipping container includes a support platen and a sidewall that has a first sidewall portion and a second sidewall portion. The first sidewall portion is connected to the support platen and the second sidewall portion such that the first sidewall portion physically separates the second sidewall portion from the support platen.

21 Claims, 4 Drawing Sheets

PACKAGING INSERT AND METHOD

BACKGROUND

Conventional paper based packaging materials are often inadequate in meeting shock and vibration absorption requirements in shipping articles. In some cases where cushioning depends upon structure failure of the packaging materials, such as built-up corrugated pad, for example, the crushing of the material requires a great deal of force, i.e. a high G load, to be exerted on the article before cushioning is obtained from the material structure failing. In other cases where cushioning is provided by material compression in the use of more flexible polymeric based materials, for example, a polystyrene foam, sufficient thicknesses can typically absorb only one impact. Even though only a portion of the polystyrene foam may be compressed upon impact, fragile articles are susceptible to repeated shocks to the shipping container. The performance of the packaging materials can also vary based on the manner in which the user packages the article.

In addition, many conventional packaging materials pose environmental and cost concerns. For example, the use of many structure failing materials typically requires that large volumes of packaging be used. These materials can take up excessive warehouse space and usually require larger shipping containers which are more expensive to purchase and ship. The use of many flexible or foam materials, for example, those made from plastics, can generally be recycled at a rate of only 25% rate to produce adequate physical properties for reuse, and the stockpiling of the waste poses an environmental problem.

Therefore, the tradeoffs involving performance, cost and environmental waste make many conventional packaging materials and constructions undesirable.

BRIEF DESCRIPTION OF THE SEVERAL VIEWS OF THE DRAWINGS

Example embodiments of the present invention can be understood with reference to the following drawings. The components in the drawings are not necessarily to scale. Also, in the drawings, like reference numerals designate corresponding parts throughout the several views.

DETAILED DESCRIPTION

Figure 1:
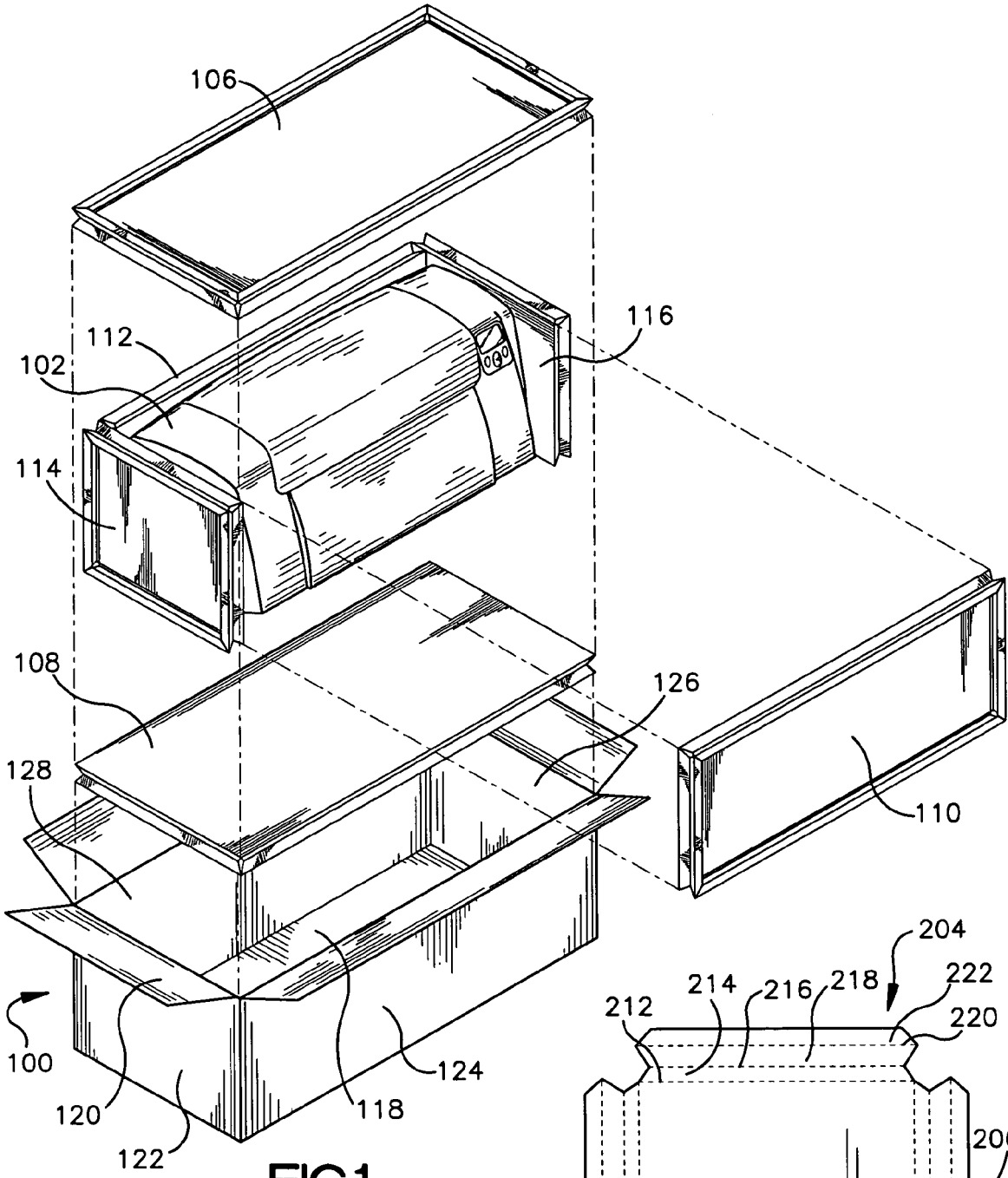
FIG. 1 is an exploded perspective view of a shipping container, an article to be shipped and at least one packaging insert according to an embodiment of the invention.

FIG. 1 illustrates a shipping container 100 used to enclose an article 102 for shipping such as, for example, a computer printer or other device. The shipping container 100 can be rigid or semi-rigid and can be made of a variety of materials, for example, cardboard, corrugated fiberboard, plastic or other appropriate materials, providing structural integrity to withstand shipping and handling loads. The top, bottom, front, rear, left lateral and right lateral packaging inserts 106, 108, 110, 112, 114, and 116, are placed into the shipping container 100 to protect the article 102 from shock and vibration forces. The bottom packaging insert 108 and the top packaging insert 106 can be positioned to contact the bottom face 118 and top face cover flaps 120, respectively, so that there is a relatively tight fitting arrangement between the packaging inserts 106, 108, and article 102. Similarly, the front, back, left lateral and right lateral inserts 110, 112, 114, and 116 can be positioned to contact longitudinal sidewalls 122, 124, 126, 128, respectively, of the shipping container 100.

The packaging inserts 106, 108, 110, 112, 114 and 116 can be made from biodegradable materials, such as cellulose based products which include but are not limited to paper, cardboard, and corrugated fiberboard products that include two or more sheets of paper separated by fluted medium. Other materials, for example, flexible plastics and rubber may be alternatively used, and the desirability of their use may depend on performance, cost and recycle ratio, etc.

Figure 2:
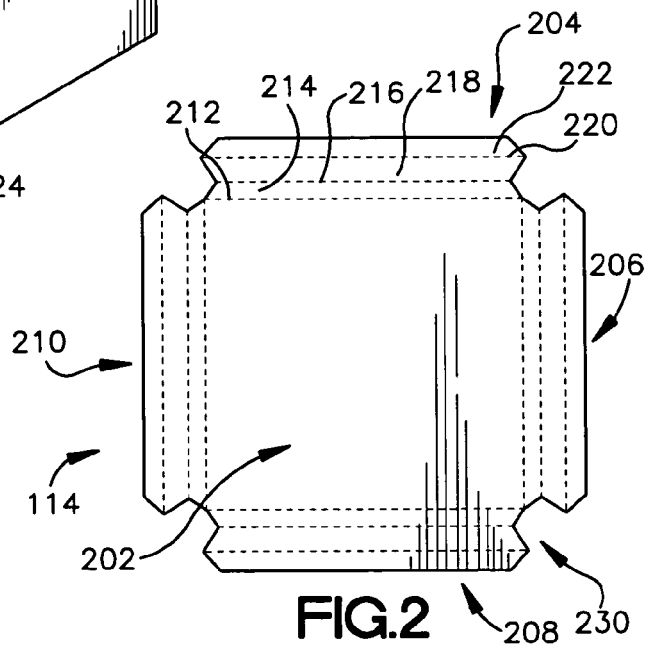
FIG. 2 is a plan view of one of the packaging inserts of FIG. 1 in its flat layout according to an embodiment of the invention.

FIG. 2 shows an example embodiment of the packaging insert, for example, packaging insert 114 (FIG. 1), in a flat layout. The packaging insert 114 can be stored flat prior to use and formed into a three-dimensional unit at the time of packing the article 102. Packaging insert 114 includes a central support platen 202 and four extending sidewalls 204, 206, 208, and 210. The sidewalls 204, 206, 208 and 210 can be integral to the support platen 202 or can be attached thereto, for example, by a tape or an alternative method. The extending sidewalls 204, 206, 208 and 210 are moveable with respect to the support platen 202 and are capable of cushioning an article from impact, as will be further described below.

Each of the extending sidewalls 204, 206, 208, and 210 include first folding line 212, a first sidewall portion 214, second folding line 216 and a second sidewall portion 218. Thus, first sidewall portion 214 separates second sidewall portion 218 from support platen 202. The first folding line 212 allows the first sidewall portion 214 to be moved relative to the support platen 202 and second folding line 216 allows the second sidewall portion 218 to be moved relative to the first sidewall portion 214.

In packaging an article 102 (FIG. 1) for shipment according to an embodiment of the invention, first sidewall portion 214 of extending sidewall 204 is folded inwardly toward the support platen 202 and the second sidewall portion 218 is folded outwardly away from the support platen 202 and toward the shipping container 100. The extending sidewalls 204, 206, 208, 210 of packaging insert 114 can be connected together, for example, via an adhesive, film or tape, or extended tabs from extending sidewalls 204, 206, 208, 210, or tabs from support platen 202, so that an air pocket is formed between the sidewalls 204, 206, 208, 210 and the support platen 202, and between the shipping container 100 and the support platen 202.

Each of the extending walls 204, 206, 208, 210 can optionally include three or more sidewall portions, for example, 214, 218, 222, (shown in FIG. 2) folded in alternating opposite directions. For example, extending sidewall 214, can optionally include a third folding line 220 and a third sidewall portion 222. In such case, the third folding line 220 allows the third sidewall portion to be moved relative to the second sidewall portion 218 and the third sidewall portion 222 is folded inwardly toward the second sidewall portion 218. In an alternative embodiment, packaging insert 114 can include a fourth sidewall portion (not shown) which connects to third sidewall portion 222 and which folds outwardly toward shipping container 100. In yet another embodiment, packaging insert 114 can further include a fifth sidewall portion which folds inwardly toward the fourth sidewall portion.

The overall depth of the packaging insert 114 can be determined in part by the length of sidewalls 204, 206, 208 and 210. The sidewall portions of extending walls 204, 206, 208, 210 can resiliently fill the shipping container 100 in conjunction with article 102. The number and length of sidewall portions can depend in part by the load of the article 102 to be shipped and the material used for the packaging insert 114, and can be determined by one of ordinary skill in the art. The relative lengths of the sidewall portions, for example the relative lengths of first and second sidewall portion 214, 218, can affect the degree of cushioning provided by the packaging insert 114 as will be further described below.

Referring to FIG. 1, according to an embodiment of the present invention, an article 102 may be packaged for shipment by placing the bottom packaging insert 108 into the bottom of the shipping container 100 and placing four packaging inserts 110, 112, 114, and 116 along the longitudinal sidewalls 122, 124, 126, and 128, of the shipping container 100 with the support platens of each of the packaging inserts facing internal to the shipping container 100. Next, the article 102 to be shipped inside the shipping container 100 is placed into the shipping container 100 and a top packaging insert 106 is placed onto the article 102 such that the support platen of packing insert 106 is facing inside the shipping container 100 before sealing the top face cover flaps 120. Although there are six packaging inserts shown used in packaging article 102 in shipping container 100, the number of packaging inserts used in the shipping container 100 can vary depending upon the geometry of the shipping container 100 as well as the nature of the article to be shipped.

Figure 3A:
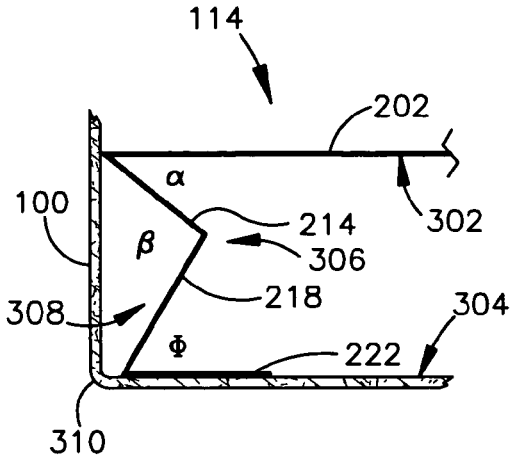
FIGS. 3A through 3E are cross sectional views of the shipping container and the packaging insert of FIG. 2 at various stages of impact according to an embodiment of the invention.

FIG. 3A is a partial cross-sectional view of packaging insert 114, for example, located inside shipping container 100 which is turned on its longitudinal sidewall 122 (FIG. 1). First, second and third sidewall portions 214, 218, 222 are folded at folding lines 212, 216, 220, (FIG. 2), respectively, and held into position upon insertion into the shipping container 100. Packaging insert 114 sits inside the shipping container 100 such that the first and second sidewall portions 214, 218, suspend the support platen 202 from the inside surface 304 of the shipping container 100. The inwardly facing surface 306 of first sidewall portion 214 (sidewall 204 FIG. 2) is folded inwardly toward the externally facing surface 302 of support platen 202, such that support platen 202 and the first sidewall portion 214 form a v-shape. First sidewall portion 214 is positioned at an angle alpha, $\alpha$, relative to support platen 202.

The second sidewall portion 218 is folded outwardly toward the externally facing surface 308 of first sidewall portion 214. The first sidewall portion 214 and the second sidewall portion 218 form a v-shape and second sidewall portion 218 is positioned at an angle beta, $\beta$, relative to first sidewall portion 214. The third sidewall portion 222 is folded inwardly toward the internally facing surface 306 of second sidewall portion 218. Third sidewall portion 222 and the second sidewall portion 218 also form a v-shape and third sidewall portion 222 is positioned at an angle phi, $\phi$, relative to second sidewall portion 218. Angles alpha and phi are less than about 90 degrees when packaging insert 114 is placed inside the shipping container 100 or under preload conditions. Angle beta can be less than about 180 degrees. In an alternative embodiment, angle phi ranges from about 35 degrees to about 80 degrees and angle beta ranges from about 35 degrees to about 180 degrees.

Packaging insert 114 separates article 102 being protected from shipping container 100 to withstand loads that are transmitted by impact and to prevent transmission of excessive amount of these loads to the article 102. Preloading of article 102 onto support platen 202 holds the second sidewall portion 218 into place so that the structure must flex when placed under pressure.

The optional third sidewall portion 222 helps direct the second sidewall portion 218 toward the corner 306 of shipping container 100. The positioning of the second sidewall 218 into the corner 306 of shipping container 100 can help ensure that the second sidewall portion 218 remains substantially stationary to buttress the support platen 202 under load, the details of which will be further described.

Figure 3B:
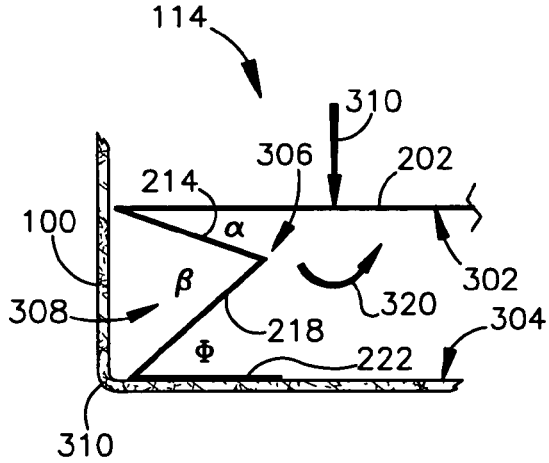

FIGS. 3B through 3E illustrate the movement of the packaging insert 114 at various stages of impact experienced by the shipping container 100 according to an embodiment of the invention. In FIG. 3B the downward force, as represented by arrow 310, exerted by the article 100 (FIG. 1) on packaging insert 114 upon impact to the longitudinal sidewall 122 (FIG. 1) of shipping container 100 causes flexing of first and second sidewall portions 214, 218. The flexing of the first and second sidewall portions 214, 218 creates an opposing pneumatic pressure and mechanical resistance, represented by arrow 320, on the externally facing surface 302 of support platen 202 to reduce the deceleration of the object at impact. Therefore, in the case of packaging insert 114 having four extending sidewalls 204, 206, 208, and 210 (FIG. 2) folded underneath the support platen 202, an opposing pneumatic force is created when the platen rapidly moves toward the shipping container 100 upon impact. The sealing of any open seams of the packaging insert 114, for example, at the seams created by joining the four extending sidewalls 204, 206, 208, and 210, of packaging insert 114, at the corner 230 (FIG. 2), for example, will increase the pneumatic force. Seams and openings can be sealed by adhesive materials such as tape, or film for example.

Figure 3C:
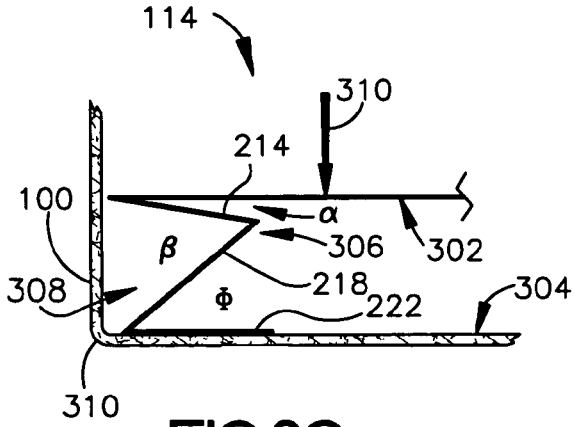
Figure 3D:
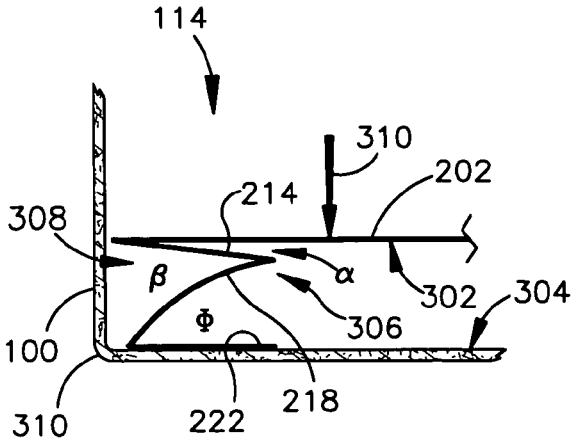
Figure 3E:
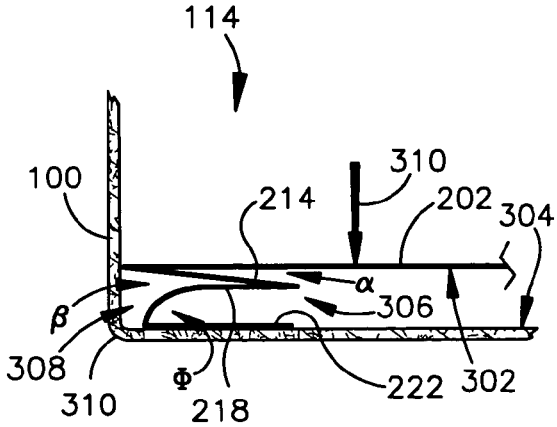

In FIG. 3C as the article 102 (FIG. 1) is forced toward the shipping container 100, the platen moves 202 moves closer to first sidewall portion 214. As angle alpha approaches zero, the decelerated load exerted by article 102 compresses second sidewall 218 which is buttressed against shipping container 100. FIG. 3D illustrates the mechanical failure as second sidewall portion 218 bends between the fold lines 216, 220 (FIG. 2) of second sidewall portion 218. FIG. 3E shows that even upon structure failure of second sidewall portion 218 the support platen 202 is prevented from making contact with shipping container 100 when the externally facing surface 302 of the support platen 202 contacts the first sidewall portion 214.

It has been found that the relative lengths of first sidewall portion 214 and the second sidewall portion 218 result in different cushioning effects of the packaging insert 114. For example, when the length of the first sidewall portion 214 is less than the length of the second sidewall portion 218 the downward force results in a mechanical failure of second sidewall portion 218 as described in illustrated in FIGS. 3D and 3E. When the support platen 202 collapses against the first sidewall portion 214, having a relatively shorter length than the second sidewall portion 218, the angle phi can be greater than about 45 degrees and the second sidewall portion 218, buttresses the support platen 202.

In another embodiment of the invention, the length of the first sidewall portion 214 can be greater than length of the second sidewall portion 218. Referring to FIGS. 3A through 3E, as the support platen 202 moves toward the shipping container 100 and angle alpha approaches zero, then the first sidewall portion 214 will come into contact with the externally facing surface of support platen 302 and the first sidewall portion 214 will pull the relatively shorter second sidewall portion 218 away from the corner 306. Therefore, as the support platen 202 continues to move toward the shipping container 100, the second sidewall portion 218 will be unable to buttress the support platen 202 against the corner 306 of the shipping container 100, the angle phi will become less than about 45 degrees and the second sidewall portion will lie substantially flat against the container 100 or the third sidewall portion 222 if present.

In another embodiment of the invention, the length of the first sidewall portion 214 can be approximately equal to the length of the second sidewall portion 218. In such case, as the support platen 202 moves toward the shipping container 100 under the load, the second sidewall portion 218 will fold against the sidewall portion 214 and will be unable to buttress the support platen 202 from the corner 306 of the shipping container 100. That is, the second sidewall portion 218 will collapse against the shipping container 100 or against the third sidewall portion 222, if present.

In all of the above embodiments, however, an opposing pneumatic force, represented by arrow 320 (FIG. 3B) is applied to the support platen 202, and when the length of the second sidewall portion 218 is greater than the length of the first sidewall portion 214, the packaging insert 114 uses both air cushioning and mechanical failure cushioning. Following the absorption of shock, the flexibility of the material and the inherent resiliency of the design of packaging insert 114, allows the first sidewall portion 114 and second sidewall portion 118 to return or recover to their original or near original shape and position, and therefore allows for the absorption of repeated shock impacts with minimal deterioration.

Figure 4:
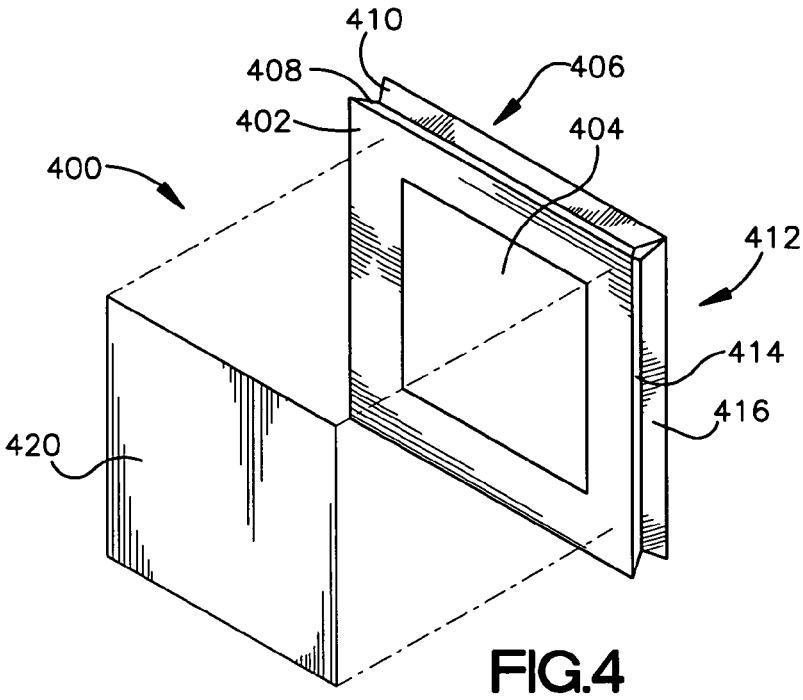
FIG. 4 is an exploded perspective view of a packaging insert having an opening covered by pliable film according to an embodiment of the invention.

FIG. 4 illustrates another embodiment of the invention in which a packaging insert 400 includes a support platen 402 which defines an opening 404. The opening 404 can be large enough to pass the article 102 (FIG. 1) through the support platen 402. The support platen 402 may be made from a flat panel, blank of rigid or semi-rigid material, but does not have to be continuous. That is, the support platen 402 can be made of four or more separate strips of material bonded together or made of a die cut plane or section. Packaging insert 400 further includes extended sidewalls, for example, sidewall 406 having a first sidewall portion 408 and second sidewall portion 410, and sidewall 412 having first sidewall portion 414 and second sidewall portion 416. The extended sidewalls 406 and 412 operate in the same manner to cushion the impact transmitted to article 102 as described above relative to the sidewall 204 of packaging insert 114 through movement of air and mechanical resistance to reduce the speed of impact and in some embodiments to through both the movement of air to decelerate and the mechanical failure.

Packaging insert 400 further includes a sheet of pliable film secured to the support platen 402 to cover opening 404. The pliable film can be secured to the support platen 402 by applying a coating of tacky material or adhesive to either the pliable film or the support platen 402 or both. Alternatively, the pliable film can be a self-adhesive that onto the support platen 402 and can additionally adhere separated panels that can make up the support platen 402.

The material construction of the packaging insert 400 can be made of renewable raw materials and can be up to 100% biodegradable. The platen 402 and extending sidewalls can be made from biodegradable materials, such as cellulose based products which include but are not limited to paper, cardboard, and corrugated fiberboard products that include two or more sheets of paper separated by fluted medium, or other materials, such as rubber and plastics as described above with respect to packaging insert 114 (FIGS. 1-3). The pliable film may be made from one or more of many flexible materials that are biodegradable or recyclable, including but not limited to elastomeric film, such as polyurethane, polyethylene, polypropylene, and vinyl, for example; a resilient laminate; a woven fabric; and netting. If an adhesive is used to secure the pliable film to the support platen 400, a suitable adhesive can be a hot melt made from recyclable polymers, a solvent adhesive containing starch, for example. Packaging insert 400 may use less material mass than the equivalent expanded polymer foam material therefore lowering the recycling costs versus other recycled materials. It is also possible that packaging insert 400 can be recycled in conjunction with the shipping container 100.

Figure 5:
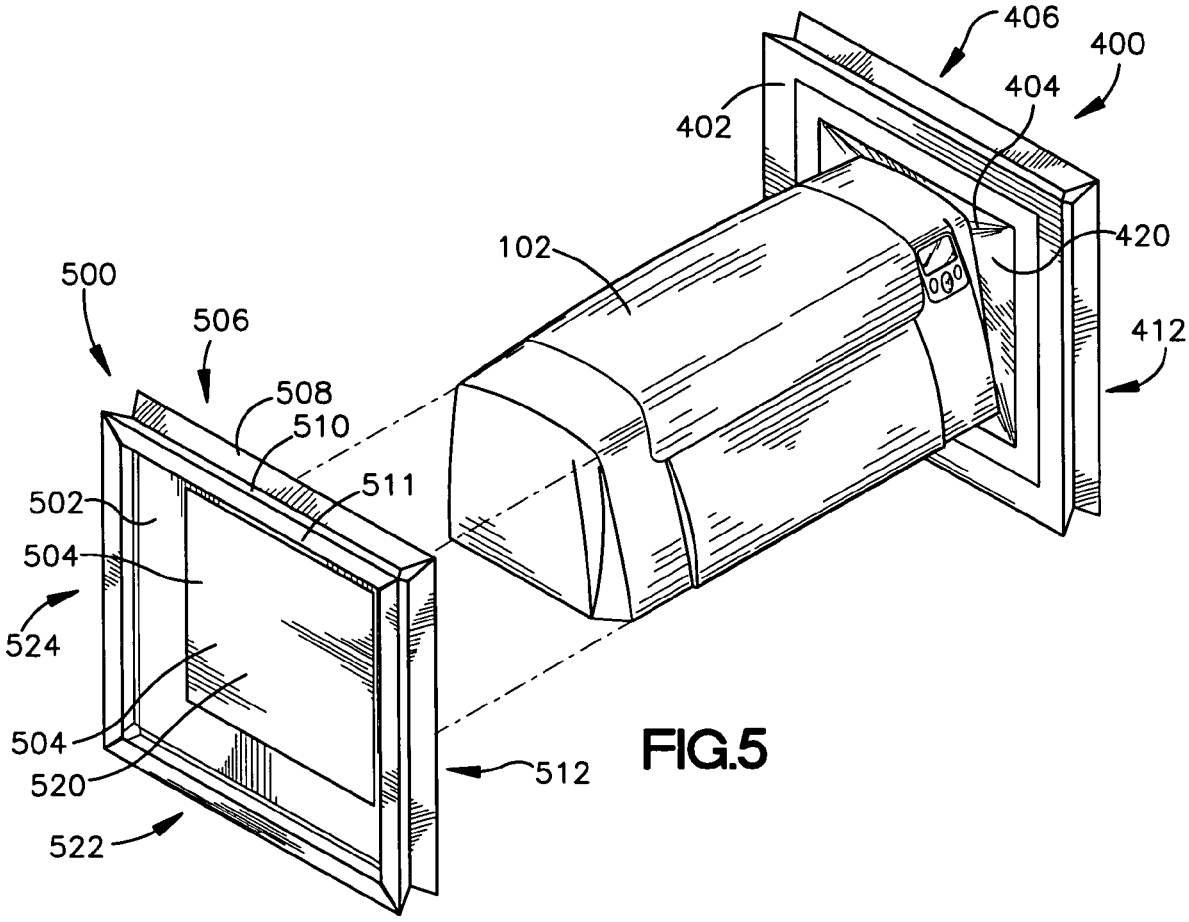
FIG. 5 is a exploded view showing an article for shipping supported by two units of the packaging insert shown in FIG. 4 according to an embodiment of the invention.

FIG. 5 shows the manner in which an article 102 for shipping is supported by the packaging insert shown in FIG. 4 according to an embodiment of the invention. Packaging insert 400 and packaging insert 500 are positioned along two opposite ends of article 102 prior to placing the packaging inserts 400, 500 and the article 102 into the container. Packaging insert 500 includes support platen 502, and extending sidewalls 506, 512, 522, 524. Extending sidewalls, for example extending sidewall 506 have a first, second and an optional third sidewall portions 508, 510, 511, respectively, which can be the same as the first, second, and third sidewall portions 214, 218, 222 of sidewall 214 (FIG. 2) described above. Support platen 502 defines an opening 504 large enough to pass the article 102, with packaging insert 500 being similar in shape and construction to packaging insert 400. Opening 504 is covered by a pliable film 520 which can be the same as pliable film 420.

Article 102 is aligned with the openings 404, 504 of packaging inserts 400, 500, and when the packaging inserts 400, 500 are held against the article the pliable films deform around the article 102. The pliable films are not shrunk or vacuum sealed against the article 102 but the flexibility of the pliable films 420, 520 can spread the contact area over a significant portion of the article 102. The extending sidewalls 506, 512, 522, 524 are held in position when the packaging inserts 400, 500 and article 102 are inserted into the shipping container 100.

Figure 6:
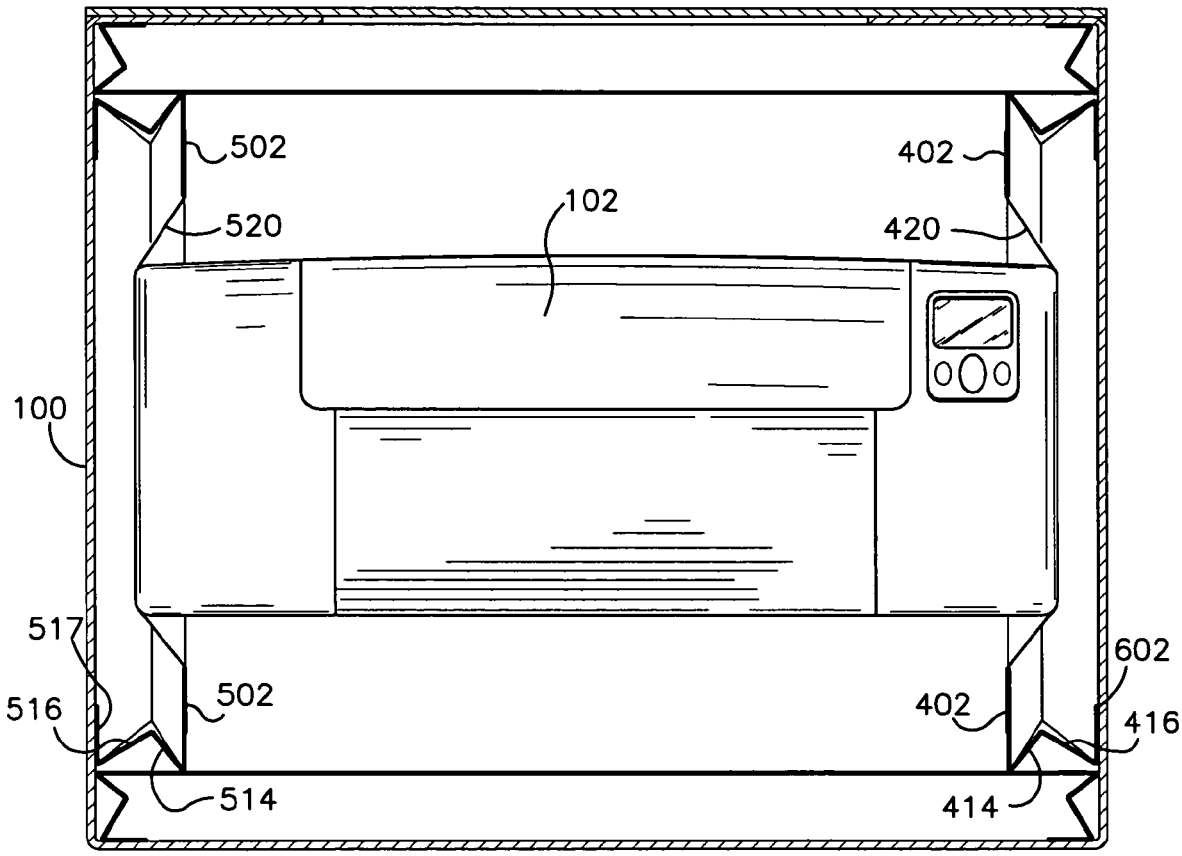
FIG. 6 is a cross-sectional view of a shipping container with the packaging inserts and article of FIG. 5 positioned inside a shipping container according to an embodiment of the invention.

FIG. 6 shows a front cross-sectional view of the shipping container 100 enclosing the packaging inserts 400, 500, which suspend the article 102. Shipping and handling loads are transferred from the container 100 to the packaging inserts 400, 500 which can cushion the load by generating a pneumatic force on the support platens and pliable films 420, 520 and in some cases by imparting a mechanical force on the sidewalls, for example, second sidewall portions 414 and 510. In addition, shipping and handling loads can be transmitted by tension of the pliable films 420, 520 or friction between the pliable films 420, 520 and the article 102, or both. That is, large shock loads to the article 102 can be reduced by the trampoline-like action of the pliable film in one direction and by the frictional resistance created by movement of the article between the pliable films 420, 520 in other directions. The deflection of the pliable films 420, 520 toward the shipping container 100 should not exceed the depth of the sidewalls, for example, sidewalls 406, 506, that surround the openings 404, 504.

In another embodiment, packaging inserts 400, 500 are capable of suspending multiple items to be shipped. That is, packaging insert 400 can contain a support platen with multiple openings (not shown) covered by a pliable material, with each opening surrounded by sidewalls having a first wall portion and a second wall portion similar to that of sidewalls 406, 506, multiple articles to be shipped. A second packaging insert of similar construction and having a sheet of pliable film covering the openings can be brought together with the articles sandwiched between the pliable films.

Although the invention is shown and described with respect to certain embodiments, it is obvious that equivalents and modifications will occur to others skilled in the art upon the reading and understanding of the specification. The present invention includes all such equivalents and modifications, and is limited only by the scope of the claims.

What is claimed is:

1. A packaging insert for supporting an article in a shipping container, the packaging insert comprising:

a support platen; and an extending sidewall connected to the support platen, the sidewall having a first sidewall portion and a second sidewall portion the second sidewall being physically separated from the support platen by the first sidewall portion; and wherein the first sidewall portion is movable relative to the support platen, the second sidewall portion is movable relative to the first sidewall portion, and the support platen defines an opening and the opening is covered by a pliable film.

2. The packaging insert of claim 1, wherein:

the first sidewall portion is positioned at an angle that is less than about 90° relative to an externally facing surface of the support platen; and the second sidewall portion is positioned at an angle that is less than about 180° relative to an externally facing surface of the first sidewall portion, under preload conditions.

3. The packaging insert of claim 1, wherein the second sidewall portion is positioned at an angle that is greater than about 35 degrees and less than about 180 degrees.

4. The packaging insert of claim 1, wherein the length of the first sidewall portion is greater than the length of the second sidewall portion.

5. The packaging insert of claim 1, wherein the length of the first sidewall portion is about equal to the length of the second sidewall portion.

6. The packaging insert of claim 1, wherein the length of the second sidewall portion is greater than the length of the first sidewall portion.

7. The packaging insert of claim 1, wherein the packaging insert comprises cellulose.

8. The packaging insert of claim 7, wherein the packaging insert comprises corrugated fiberboard.

9. The packaging insert of claim 1, wherein the first sidewall portion is connected to the support platen by a fold line between the first sidewall portion and the support platen, and the second sidewall portion is connected to the first sidewall portion by a fold line between the second sidewall portion and the first sidewall portion.

10. A packaging insert for supporting an article in a shipping container, the packaging insert comprising:

a support platen; and an extending sidewall connected to the support platen, the sidewall having a first sidewall portion and a second sidewall portion the second sidewall being physically separated from the support platen by the first sidewall portion; and wherein:

the first sidewall portion is movable relative to the support platen and the second sidewall portion is movable relative to the first sidewall portion;

the second sidewall portion is positioned at an angle that is greater than about 35 degrees and less than about 180 degrees; and the extending sidewall further comprises a third sidewall portion connected to the second sidewall portion, and the internally facing surface of the second sidewall portion and the internally facing sidewall portion of the third sidewall portion are positioned at an angle that is less than about 90 degrees.

11. A packaging insert for supporting an article in a shipping container, the packaging insert comprising:

a support platen; and a sidewall connected to the support platen, the sidewall having a first sidewall portion and a second sidewall portion, the first sidewall portion being disposed between the support platen and the second sidewall portion; and wherein the length of the second sidewall portion is greater than the length of the first sidewall portion and the support platen defines an opening that is covered by a pliable film.

12. The packaging insert of claim 11, wherein the first sidewall portion is positioned at an angle that is less than about 90 degrees relative to the externally facing surface of the support platen, and the second sidewall portion is positioned at an angle that is less than about 90 degrees relative to the internally facing surface of the first sidewall portion.

13. The packaging insert of claim 11, wherein the packaging insert comprises cellulose.

14. The packaging insert of claim 13, wherein the packaging insert is made of corrugated fiberboard.

15. A packaging insert for supporting an article in a shipping container, the packaging insert comprising:

a support platen; and a sidewall connected to the support platen, the sidewall having a first sidewall portion and a second sidewall portion, the first sidewall portion being disposed between the support platen and the second sidewall portion; and wherein the length of the second sidewall portion is greater than the length of the first sidewall portion and the extending sidewall further comprises a third sidewall portion connected to the second sidewall portion, and the internally facing surface of the second sidewall portion and the internally facing sidewall portion of the third sidewall portion are positioned at an angle that is less than about 90 degrees.

16. The packaging insert of claim 15, wherein the packaging insert has four extending sidewalls connected to the support platen.

17. The packaging insert of claim 16, wherein the four extending sidewalls are sealed to one another and to the support platen.

18. A packaging insert for supporting an article in a shipping container, the packaging insert comprising:

a support platen disposed in the shipping container;

a means for supporting the support platen substantially parallel to a wall of the shipping container and creating an air pocket between the support platen and the wall to cushion a shock delivered to the shipping container; and wherein the means for supporting the support platen generates a pneumatic force against the support platen when the shock is delivered to the shipping container and the support platen defines an opening that is covered by a pliable film, the pliable film comprising polymer.

19. The packaging insert of claim 18, further comprising a means for imparting a mechanical structure failure to generate a force against the support platen after generating the pneumatic force against the support platen.

20. The packaging insert of claim 19, wherein the packaging insert is made of corrugated fiberboard.

21. A method for packaging an article for shipment, the method comprising:

assembling a packaging insert by positioning an internally facing surface of a first sidewall portion at an angle less than about 90 degrees relative an externally facing surface of a support platen; and positioning an externally facing surface of a second sidewall portion at an angle less than about 180 degrees relative to an externally facing surface of the first sidewall portion; and placing the packaging insert into a shipping container such that the first sidewall portion and the second sidewall portion suspend the support platen from the inside surface of the shipping container.

* * * * *